US011844995B2

(12) United States Patent
Schmidt

(10) Patent No.: US 11,844,995 B2
(45) Date of Patent: Dec. 19, 2023

(54) WALL-TRAVERSAL AMUSEMENT ATTRACTION

(71) Applicant: Activate Games Inc., Winnipeg (CA)

(72) Inventor: Adam Schmidt, Winnipeg (CA)

(73) Assignee: Activate Games Inc., Winnipeg (CA)

( * ) Notice: Subject to any disclaimer, the term of this patent is extended or adjusted under 35 U.S.C. 154(b) by 119 days.

(21) Appl. No.: 17/149,033

(22) Filed: Jan. 14, 2021

(65) Prior Publication Data

US 2021/0220688 A1 Jul. 22, 2021

(30) Foreign Application Priority Data

Jan. 20, 2020 (CA) ..... CA 3068847

(51) Int. Cl.
*A63B 69/00* (2006.01)
*A63B 71/06* (2006.01)
(Continued)

(52) U.S. Cl.
CPC ..... *A63B 9/00* (2013.01); *A63B 69/0048* (2013.01); *A63B 71/0669* (2013.01);
(Continued)

(58) Field of Classification Search
None
See application file for complete search history.

(56) References Cited

U.S. PATENT DOCUMENTS 5,732,954 A * 3/1998 Strickler ..... A63B 69/0048 482/37
8,668,626 B1 3/2014 Horowitz et al.
(Continued)

FOREIGN PATENT DOCUMENTS

CN 1618489 5/2005
CN 106448277 3/2019
(Continued)

OTHER PUBLICATIONS

"The Hahn's Homebuilt Climbing Wall (in our Garage), Jun. 5, 2006, http://toddthahn.com/outdoors/climbing_wall" (Year: 2006).*
(Continued)

*Primary Examiner* — Shila Jalalzadeh Abyaneh
(74) *Attorney, Agent, or Firm* — Kyle R Satterthwaite; Ryan W Dupuis; Ade & Company Inc.

(57) ABSTRACT

An amusement attraction features a wall structure, a respective set of illuminable handholds distributed over a wall surface of at least one upright wall of the structure, a floor surface residing adjacent to the upright wall on a side thereof faced by the wall surface, and one or more detection devices operable to detect landing of a participant on the floor surface during attempted traversal of the wall surface. A controller is operable to illuminate the handholds in different colour-coded patterns. Each pattern includes illumination of "authorized" handholds in a first colour, illumination of "prohibited" handholds in a second colour, and illumination of "targeted" handholds in a third colour. In a game-play session, participants are tasked with grasping of the targeted handholds while traversing the wall structure, with penalties applied for detected landing of participants on the floor surface and gripping of prohibited handholds.

14 Claims, 6 Drawing Sheets

(51) Int. Cl.
*A63B 9/00* (2006.01)
*A63G 31/00* (2006.01)

(52) U.S. Cl.
CPC ..... *A63G 31/00* (2013.01); *A63B 2009/006* (2013.01); *A63B 2071/0694* (2013.01); *A63B 2220/56* (2013.01); *A63B 2220/803* (2013.01)

(56) References Cited

U.S. PATENT DOCUMENTS

| | | | | |
|---|---|---|---|---|
| 8,808,145 | B1 | 8/2014 | Parsons et al. | |
| 9,463,368 | B2 | 10/2016 | Garnier | |
| 9,539,483 | B1 | 1/2017 | Tsang | |
| 9,770,614 | B1 * | 9/2017 | Sudeith | A63B 71/0009 |
| 9,795,851 | B2 | 10/2017 | Tsang | |
| 10,653,938 | B1 * | 5/2020 | Traustason | A63B 63/00 |
| 2008/0293470 | A1 * | 11/2008 | Proud | A63F 9/24 463/9 |
| 2010/0004098 | A1 * | 1/2010 | Hensley | A63B 69/0048 482/37 |
| 2014/0266720 | A1 * | 9/2014 | McGowan | G08B 13/22 340/541 |
| 2015/0057776 | A1 * | 2/2015 | Skjaerseth | A63B 71/0616 700/91 |
| 2016/0136496 | A1 * | 5/2016 | Garnier | A63B 69/0048 315/76 |
| 2017/0028285 | A1 * | 2/2017 | Tsang | H04B 5/0031 |
| 2018/0021623 | A1 * | 1/2018 | Brendle | A63B 21/065 482/38 |
| 2018/0318626 | A1 * | 11/2018 | Jones | A63B 71/0054 |
| 2019/0176011 | A1 * | 6/2019 | Lehrer | A63B 71/0622 |
| 2020/0047048 | A1 * | 2/2020 | Bell | A63B 71/0054 |
| 2020/0197783 | A1 * | 6/2020 | Iida | G06F 3/14 |

FOREIGN PATENT DOCUMENTS

| | | | | | |
|---|---|---|---|---|---|
| CZ | 4686 | U1 * | 6/1996 | | |
| GB | 2426938 | A * | 12/2006 | | A63B 69/0048 |
| GB | 2426938 | | 8/2007 | | |
| KR | 100934130 | * | 1/2010 | | A63B 69/0048 |
| KR | 100934130 | B1 * | 1/2010 | | A63B 69/0048 |
| KR | 101586374 | * | 1/2016 | | A63B 69/0048 |
| KR | 101586374 | B1 * | 1/2016 | | |
| KR | 101985963 | | 6/2019 | | |
| WO | 2016159778 | | 10/2016 | | |
| WO | 2018211062 | | 11/2018 | | |

OTHER PUBLICATIONS

TrailBlazer Traverse Climbing Wall at Simonside Outdoor Adventures, YouTube; https://www.youtube.com/watch?v=4jq7fhkicKA.

* cited by examiner

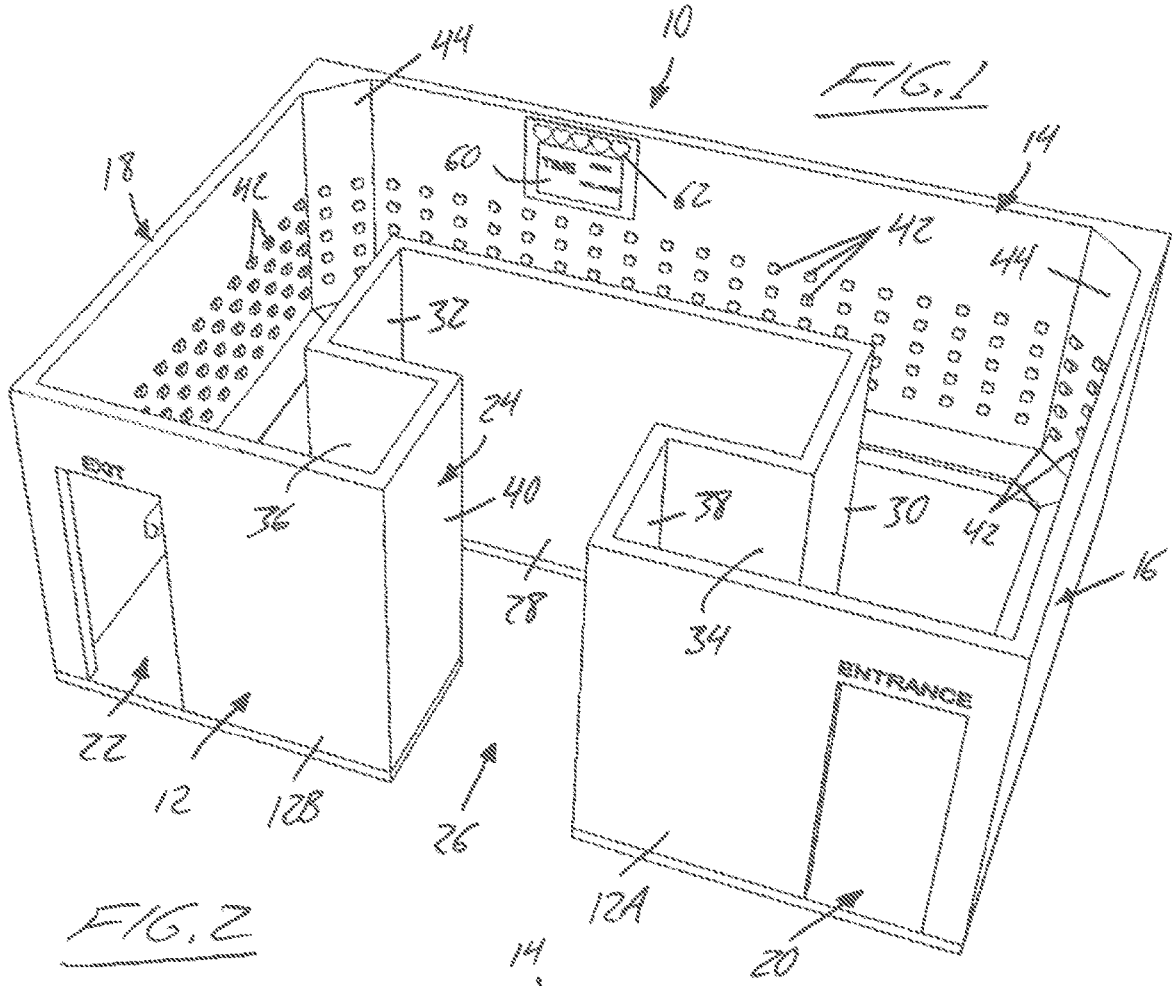
FIG. 1
FIG. 2
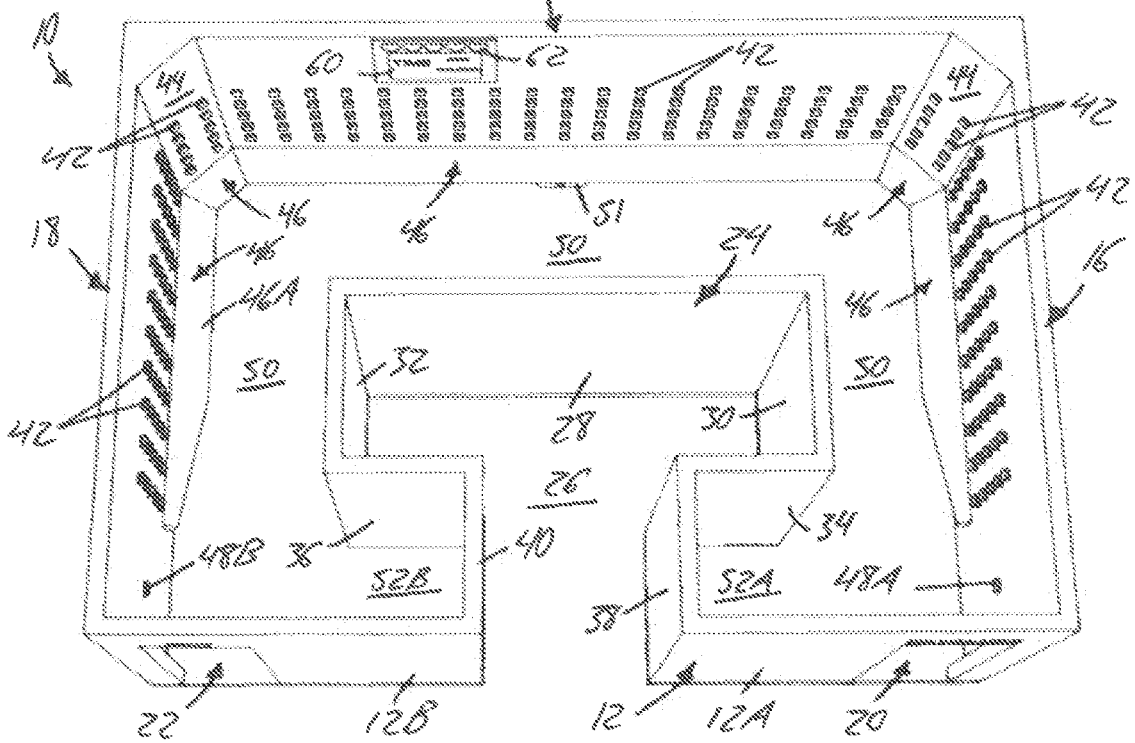

WALL-TRAVERSAL AMUSEMENT ATTRACTION

CROSS-REFERENCE TO RELATED APPLICATIONS

This application claims foreign priority benefit under 35 U.S.C. 119(a) of Canadian Patent Application 3,068,847, filed Jan. 20, 2020, the entirety of which is incorporated herein by reference.

FIELD OF THE INVENTION

The present invention relates generally to amusement attractions, and more particularly to amusement attractions in which participants traverse the surface of upright wall structures via handholds distributed over the surface area of such structures.

BACKGROUND

Indoor climbing facilities are a popular form of immersive, live-action amusement attraction. To add an extra component to the wall climbing experience, it has been proposed in the prior art to incorporate illumination means and touch sensing means into climbing holds, and to operably install these climbing holds in communication with a computerized control system using the illumination and touch sensing means to guide and monitor participant progress over the wall surface. Examples of illuminated, touch-sensing climbing holds and associated control systems can be found in CN1618489, CN106448277, GB2426938, KR101586374, KR101985963, U.S. Pat. Nos. 8,668,626, 8,808,145, 9,463,368, 9,539,483, 9,795,851, WO2016159778 and WO2018211062, each of which is incorporated herein by reference in its entirety.

Despite these prior contributions to the art, there remains room for novel developments and improvements in relation to wall-traversing amusement attractions.

SUMMARY OF THE INVENTION

According to a first aspect of the invention, there is provided an amusement system comprising:

- a wall structure comprising one or more upright walls each comprising a respective wall surface;
- a respective set of handholds installed on at least one upright wall of the structure in positions distributed over a surface area of the respective wall surface for use as hand grips by which one or more participants can support themselves on, and traverse across, said respective wall surface;
- a floor surface residing adjacent to said at least one upright wall on a side thereof faced by the respective wall surface; and
- one or more detection devices positioned and configured relative to said at least one upright wall and said floor surface to detect landing of a participant on said floor surface during attempted traversal of the respective wall surface via said set of handholds.

According to a second aspect of the invention, there is provided an amusement system comprising:

- a wall structure comprising one or more upright walls each comprising a respective wall surface;
- a respective set of handholds installed on at least one upright wall of the structure in positions distributed over a surface area of the respective wall surface for use as hand grips by which one or more participants can support themselves on, and traverse across, said respective wall surface; and
- a floor surface residing adjacent to said at least one upright wall on a side thereof faced by the respective wall surface;
- wherein the at least one upright wall comprises a footledge protruding from the respective wall surface at an elevation below the respective set of handholds and above said floor surface.

According to a third aspect of the invention, there is provided an amusement system comprising:

- a wall structure comprising one or more upright walls each comprising a respective wall surface;
- a respective set of handholds installed on at least one upright wall of the structure in positions distributed over a surface area of the respective wall surface for use as hand grips by which one or more participants can support themselves on, and traverse across, said respective wall surface;
- a respective multi-colour illumination device for each handhold that is operable to effect illumination thereof in at least first and second different colours; and
- a controller connected to the multi-colour illumination devices and configured to illuminate the handholds in a variety of different colour-coded patterns, in each of which illumination of a first subset of the handholds in the first colour visually identifies said first subset of handholds as authorized handholds to be used by a participant during traversal of the wall surface, while illumination of a second subset of the handholds in the second colour visually identifies said second set of handholds as prohibited handholds to be avoided by the participant during traversal of the wall surface.

BRIEF DESCRIPTION OF THE DRAWINGS

One embodiment of the invention will now be described in conjunction with the accompanying drawings in which:

FIG. 1 is a front perspective view of an immersive amusement attraction providing a wall-traversal course spanning from proximate an entrance of the attraction to proximate an exit thereof.

FIG. 2 is an overhead perspective view of the attraction of FIG. 1 revealing inclusion of wall-mounted goal devices near the entrance and exit of the attraction for actuation by participants upon completed traversal of the course in either direction.

DETAILED DESCRIPTION

Figure 3:
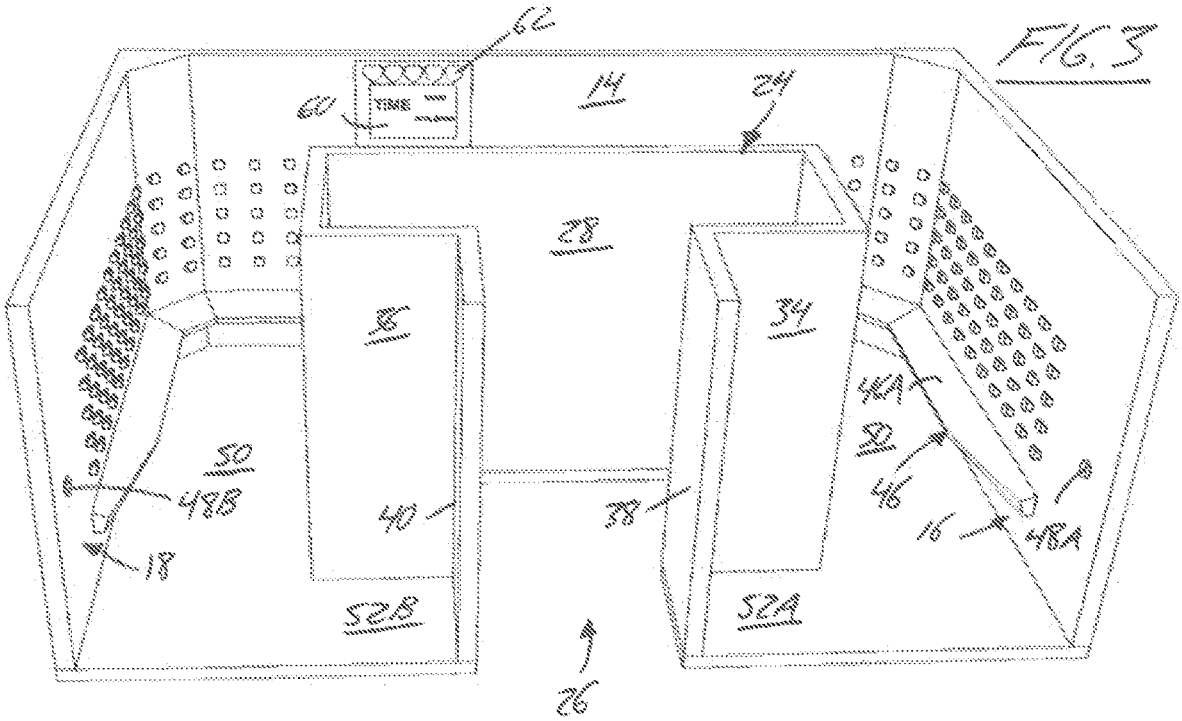
FIG. 3 is another front perspective view of the attraction of FIG. 1 with a front perimeter wall of the attraction cut away.

Referring to FIG. 1, an immersive amusement attraction 10 is shown in the form of an enclosed game room having an outer perimeter wall structure composed of a front perimeter wall 12, an opposing rear perimeter wall 14, a first perimeter side wall 16 and an opposing second perimeter side wall 18. The front perimeter wall 12 is divided into two halves 12A, 12B, which respectively feature an entrance 20 to the room and a separate exit 22 therefrom. The entrance 20 and exit 22 are situated near opposing ends of the front perimeter wall 12, and thus reside respectively adjacent the first and second perimeter side walls 16, 18. The room further comprises an inner wall structure 24 delimiting a T-shaped void space 26 that juts rearwardly into the room from between the two halves 12A, 12B of the front perimeter wall 12, and then spans laterally outward in both directions toward the first and second perimeter side walls 16, 18. The void space 26 is not accessible via the entrance and exit, and thus not accessible to participants in the attraction.

The inner wall structure 24 features a rear inner wall 28 lying in parallel and opposing relation to the rear perimeter wall 14, a first mid-side wall 30 spanning forwardly from a first end of the rear inner wall 28 toward the front perimeter wall 12 in parallel and opposing relation to the first perimeter side wall 16, a second mid-side wall 32 spanning forwardly from a second end of the rear inner wall 28 toward the front perimeter wall 12 in parallel and opposing relation to the second perimeter side wall 18, a first alcove wall 34 joined to the first mid-side wall 30 at an end thereof opposite the inner rear wall 28 and lying in parallel and opposing relation to the first half 12A of the front perimeter wall 12, a second alcove wall 36 joined to the second mid-side wall 32 at an end thereof opposite the inner rear wall 28 and lying in parallel and opposing relation to the second half 12B of the front perimeter wall 12, a first front-side wall 38 joining the first alcove wall 34 to the first half 12A of the front perimeter wall 12 at ends thereof opposite the first perimeter side wall 16 so as to lie in parallel and opposing relation thereto, and a second front-side wall 40 joining the second alcove wall 36 to the second half 12B of the front perimeter wall 12 at ends thereof opposite the second perimeter side wall 16 so as to lie in parallel and opposing relation thereto.

The rear perimeter wall 14 and the two perimeter side walls 16, 18 each feature a respective set of handholds 42 mounted thereon at a vertically upright interior wall surface thereof that faces into the interior of the room. The handholds on the first perimeter side wall 16 are distributed over a substantial surface area thereof, starting from a location situated near the entrance 20 and across from a first corner of the inner wall structure 24 that is defined between the first mid-side wall 30 and the first alcove wall 34, and spanning to a location situated adjacent a first corner of the outer perimeter wall structure that is defined between the first perimeter side wall 16 and the rear perimeter wall 14. Likewise, the handholds 42 on the second perimeter side wall 18 are distributed over a substantial surface area thereof, starting from a location situated near the exit 22 and across from a second corner of the inner wall structure that is defined between the second mid-side wall 32 and the second alcove wall 36, and spanning to a location situated adjacent a second corner of the outer perimeter wall structure that is defined between the second perimeter side wall 18 and the rear perimeter wall 14.

The handholds 42 on the rear perimeter wall 14 are distributed over a substantial surface area thereof that spans from a location adjacent the first corner of the outer perimeter wall structure to a location adjacent the second corner thereof. As illustrated, the first and second corners of the outer perimeter wall structure may feature transitional interior wall surfaces 44 that angle obliquely between the interior wall surfaces of the rear perimeter wall 14 and the respective perimeter side wall 16, 18. Each of these transitional wall surfaces 44 features a smaller respective set of handholds 42 thereon, the quantity of which is less than the quantity of handholds 42 in the larger sets on the rear perimeter wall 14 and the two perimeter side walls 16, 18.

In the illustrated embodiment, the handholds 42 of each set are arranged in a rectangular array of horizontal rows and vertical columns, whereby the handholds in each row reside at equal elevation to another and having uniform horizontal spacing between one another, and the handholds in each column reside in aligned relation one over the other with uniform vertical spacing between them. However, it will be appreciated that the handholds in each set need not necessary be arranged in a uniformly arrayed fashion. In the illustrated embodiment, the handholds 42 are all of identical size and shape to one another, though again, this need not necessarily be the case. Each handhold 42 protrudes from the respective wall surface, and so the handholds distributed over the substantial surface area of each wall surface are usable as hand grips by which one or more participants can support themselves on, and traverse across, said wall surface.

The handhold-equipped outer perimeter wall structure thus defines a course that participants can traverse in wall-gripping fashion starting from near the entrance 20 of the room, all the way around to near the exit 22 of the room. The participants can likewise traverse this same course in the reverse direction from near the exit 22 of the room back to near the entrance 20 of the room. Unlike conventional wall-climbing attractions, where the participant's travel direction is primarily vertical, with the goal of reaching an elevated "finish line" from an initial ground-level "starting line", the participant is instead tasked with traversal of the course in generally horizontal fashion from a starting point near the entrance to a finish point near the exit, or vice versa. In the illustrated example, where three sides of an externally rectangular room are equipped with the handholds, the course spans a generally U-shaped path between the entrance and exit that are both situated at a same front side of the room, though at opposite ends of that front side. However, it will be appreciated that the shape of the room, the relative positions of the entrance and exit, and the number and relative orientations of walls that collectively form the wall-traversal course may be varied.

Each handhold is of a type incorporating therein a sensor operable to detect gripping thereof, for example in the form of a capacitance touch sensor, and also incorporating a multi-colour illumination device, for example a multi-colour LED, and more particularly a multi-colour illumination device preferably illuminable in at least three different colours, for example a tri-colour LED illuminable in red, green and blue (i.e. an RGB LED). As outlined in the background section above, constructional and operational details of handholds incorporating touch sensors and multi-colour illumination devices, and computer control and communication therewith, are already known in the art, and are therefore not specifically detailed herein.

In the illustrated embodiment, the respective set of handholds 42 on each wall surface is accompanied by an underlying foot ledge 46 that protrudes from the interior wall surface over an entire horizontal length of the surface area that si occupied by said handholds. Accordingly, each participant traversing the surface area of the wall can stand on the foot ledge 46 as they do so, thus using the wall mounted holds solely as "handholds" for manual gripping to maintain the participant's balance on the foot ledge 46, rather than also using some of the wall-mounted holds as "footholds" for leg-borne support of the participant's body weight. That being said in other embodiments, for a more challenging experience, the foot-ledge may be omitted, whereby the wall-mounted holds collectively provide a combination of both handholds and footholds. In the illustrated embodiment, so as not to overly minimize the challenge, the top surface 46A of the foot-ledge 46 on which the participant stands has an obliquely downward slope from the wall surface, whereby the participant's weight will gravitationally bias them downwardly off of the foot-ledge 46. The use of identical handholds throughout the course, the uniform distribution of the handholds in rectangular arrays, and the inclusion of the foot ledge 46 makes the course traversable even to participants with zero wall-climbing experience. The wall-traversal attraction is thus particularly suited for use as one game room among a multi-room amusement facility with other types of game rooms installed therein, as opposed to use at a dedicated "wall climbing" facility. That being said, more complex course configurations may alternatively be adopted, for example through the variations contemplated above.

Figure 4:
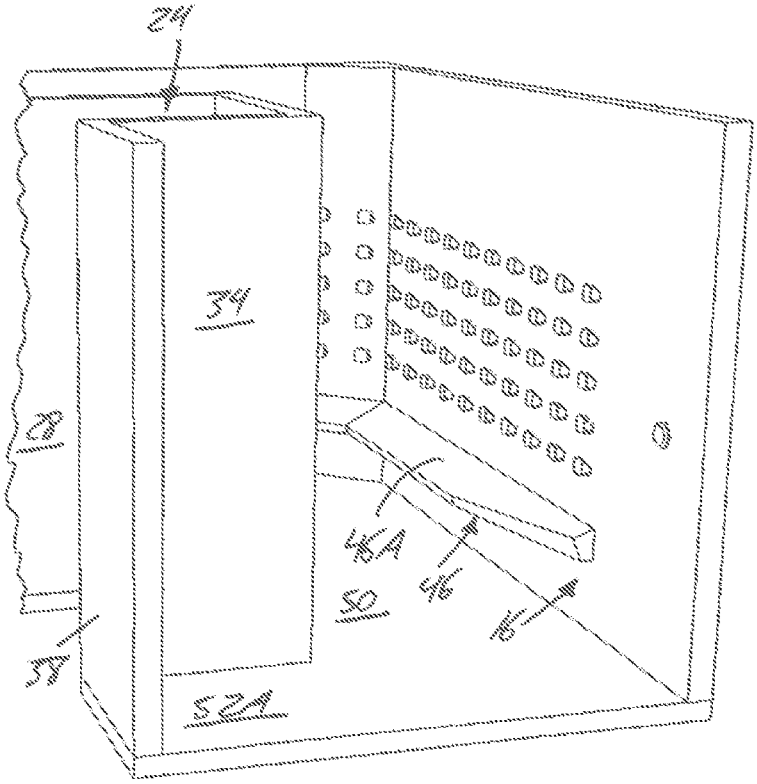
FIG. 4 is a partial closeup view of the attraction of FIG. 3.

In the illustrated embodiment, for the purpose of detecting successful traversal of the course in either direction, a respective goal device 48A, 48B is installed adjacent each end of the course near the entrance 20 or exit 22, for example in wall-mounted fashion on a respective one of the perimeter side walls 16, 18 so as to reside just forwardly beyond the respective handhold set on that perimeter side wall 16, 18. The goal device 48A, 48B may be reachable while standing at or near the corresponding terminal end of the respective foot ledge 46, or may be positioned slightly out of reach from the end of the foot ledge 46 so as to require that a participant first dismount the terminal end of the foot ledge 46 before actuating the goal device 48A, 48B. As shown in the drawings, the challenge of reaching the goal device may be increased by having the foot-ledge 46 narrow in width toward its terminal end at each end of the course, as can be seen in FIGS. 2 through 4. Each goal device is used to detect physical user-input from a participant to confirm the participant's successful traversal of the course from one end thereof to the other. Each goal device 48A, 48B may be a push-button device, touch-sensitive panel, or any other electronic device capable of receiving a detectable physical input denoting an actuation of said device. While the illustrated example features only two goal devices, one at each end of the course, more than one goal device may optionally be provided at one or both ends of the course.

During participant in the amusement attraction, a participant or group of participants is tasked with traversal of the course from one end to the other using the handholds and foot ledges, without falling therefrom to an adjacent floor surface 50. This floor surface 50 that spans between the outer perimeter wall structure and the inner wall structure 24 over the full length of the course, i.e. from where the handholds 42 and foot ledge 46 start on the first perimeter side wall 16 near the entrance 20 to where the handholds 42 and foot ledge 46 end on the second perimeter side 18 wall near the exit 22. This floor surface 50 spanning the length of the course and residing adjacent the hold-equipped perimeter walls 14, 16, 18 thus denotes a penalty zone, where detected landing of a participant on the floor surface 50 denotes a failed attempt to complete the assigned wall-traversal task.

Figure 5:
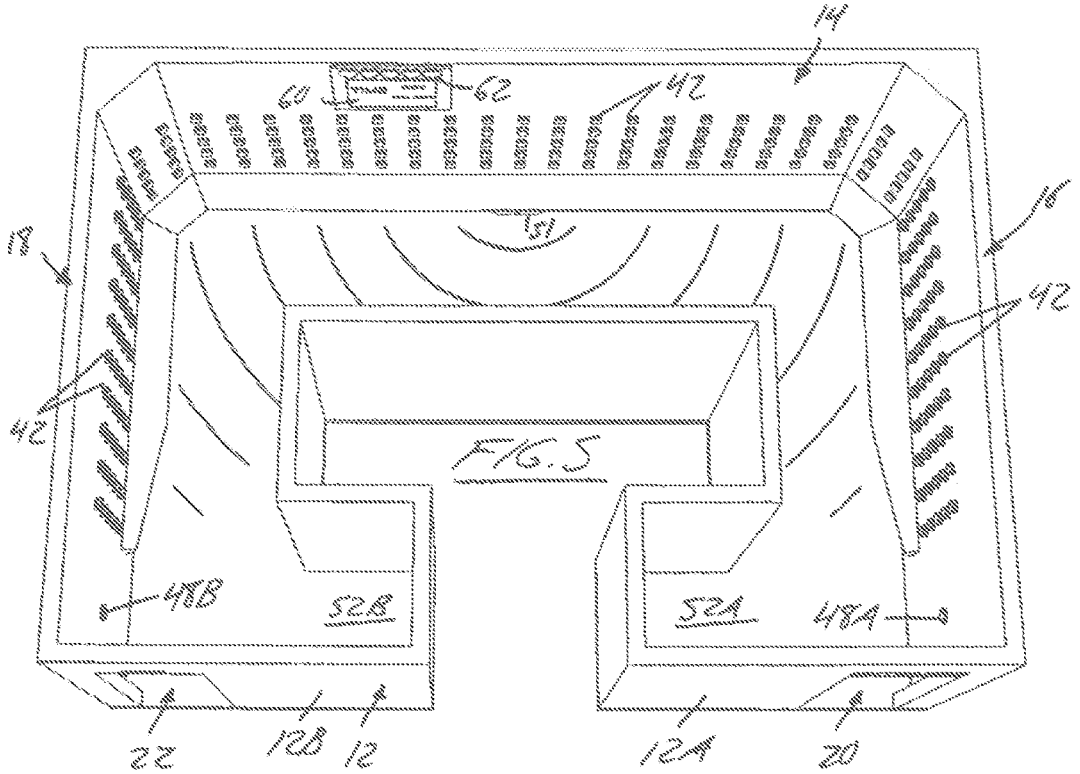
FIG. 5 is another overhead perspective view of the attraction of FIG. 2, but schematically illustrating use of a fall-detection device to monitor for falling of participants from the wall-traversal course to an adjacent penalty-zone floor surface.

For the purpose of detecting such failures, a fall detection system comprises at least one detection device 51 operable to detect such landing of a participant on the floor surface 50. With reference to FIG. 5, in the illustrated example, a scanning laser rangefinder (e.g. UST-10LX by Hokuyo) is used as a singular fall detection device 51 that resides centrally of the rear perimeter wall 14 beneath the foot ledge 46 thereof. The fall detection device 51 takes laser-reflection distance measurements over a predetermined angular span that has been selected according to the room geometry to cover the full length of the course. The scanned distance measurements are compared against stored values that would be expected in instances where the penalty zone floor surface 50 is unoccupied, i.e. the values that would be expected for reflection of the emitted laser from the various wall surfaces of the room when occupied by any participants. If the value measured at any angular point in the scanned angular range is less than the anticipated value for that angular point, this confirms the presence of a participant at this point of the device's prescribed scanning range, thus having positively detected a fallen participant on the penalty zone floor surface 50.

In the example of the illustrated room shape, the alcove walls 34, 36 of the inner wall structure 24 create safe-zone alcove spaces 52A, 52B that reside respectively adjacent the entrance 20 and exit 22 of the room. Each safe-zone alcove space 52A, 52B resides in opposing relation to the nearest hold-equipped perimeter side wall 16, 18, and is shielded from the scanning area of the fall-detection device 51. Accordingly, one or more participants can stand in each safe-zone alcove space 52A, 52B without triggering a false fallen-participant penalty. In the meantime, the two safe-zone alcove spaces 52A, 52B are physically isolated from one another by the front-side walls 38, 40 of the inner wall structure 24, whereby the only way for a participant to travel from one end of the wall-traversal course to the other end of the wall-traversal course is through the course itself. The inclusion of safe zones 52A, 52B shielded from, or otherwise situated outside the operable range of, the fall-detection device 51 thus enables multi-participant gameplay, where multiple participants can start traversing the course one after another from a starting end of the course without worry that a waiting participant in the starting safe zone will trigger a false fallen-participant penalty. Likewise, a first participant having successfully traversed the course to a finishing end thereof can step into the adjacent finishing safe zone without triggering a false fallen-participant penalty, and wait for trailing participants to complete the course behind them.

On the other hand, the inclusion of safe zones 52A, 52B also introduces a potential cheating scenario in instances where a gameplay session involves tasking participants with traversal of the course in both directions. For example, during a first task of traversing the course from the entrance-adjacent end to the exit-adjacent end, one participant among a team of multiple participants could stay behind the first safe zone 52A, while one or more other team members traverse the course to the exit-end thereof and actuate the exit-adjacent goal device 48B. Then, when the team is next tasked with traversal of the course in the reverse direction back to the entrance-adjacent end, the waiting participant that stayed behind in the first safe zone 52A could simply actuate the entrance-adjacent goal device 48A to try and trick the system to believe that they had traversed the course in the reverse direction.

Figure 6:
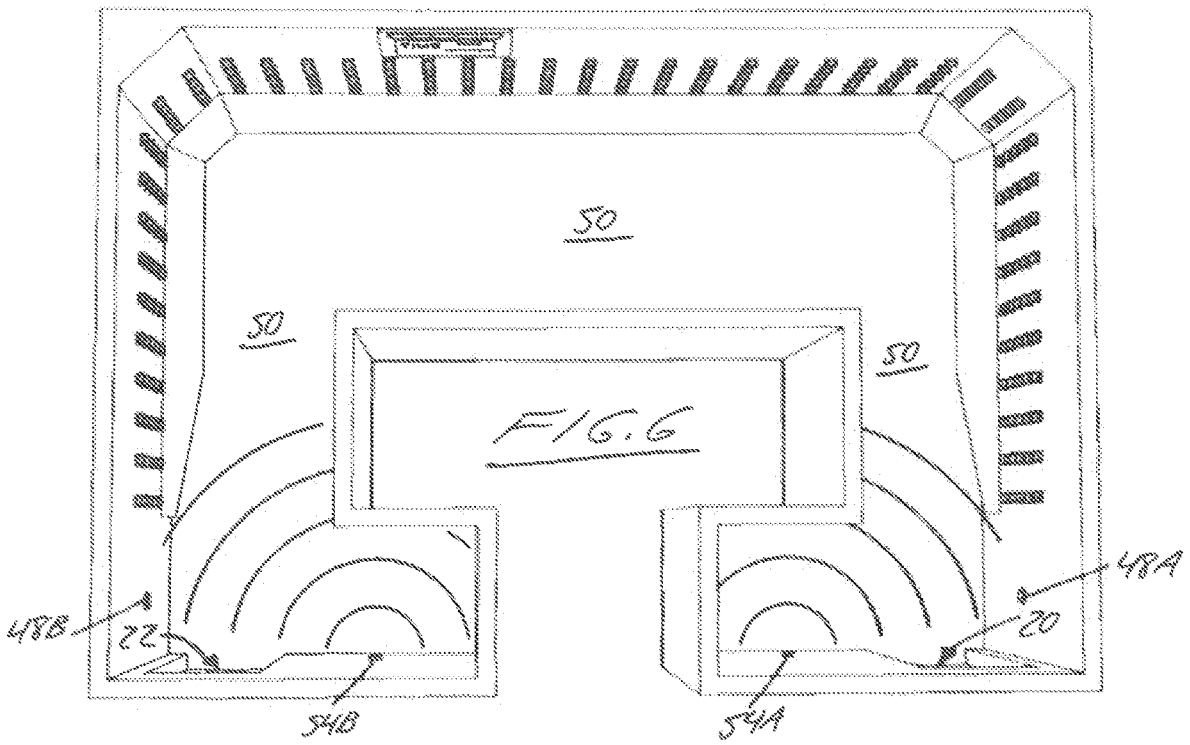
FIG. 6 is another overhead perspective view of the attraction of FIG. 5, but schematically illustrating use of cheat-detection devices monitoring for presence of participants in safe-zones next to the entrance and exit.

With reference to FIG. 6, to enable two-way course traversal gameplay sessions, but prevent such cheating scenarios, the illustrated embodiment includes a pair of safe-zone detection devices 54A, 54B each operable to monitor for the presence of any participant in a respective one of the safe zones 52A, 52B. In the illustrated embodiment, each safe-zone detection device 54A, 54B comprises a respective camera positioned to capture images of the respective safe-zone. Object detection software is used on the captured images to discern between the presence and absence of participants in the respective safe zone. As shown in FIG. 6, such detection devices may optionally be wall-mounted devices mounted in the safe-zone alcoves 52A, 52B. Though shown on the front perimeter wall 12 of the room in the illustrated example, these safe-zone detection devices 54A, 54B may be mounted at any location suitable to encompass the safe zone within their field of view, for example on the alcove walls 34, 36; on the front-side walls 38, 40 of the inner wall structure 24; on the perimeter side walls 16, 18 of the outer perimeter structure at positions across from the safe zone alcoves 54A, 54B; or even on the ceiling above the safe zone alcoves.

It will be appreciated that depending on the geometry of the room and the particular placement and setup of one or more fall detection devices 51, the safe zones need not necessarily be alcove spaces, so long as they are shielded from or situated outside the operable range of the fall detection device(s). It will also be appreciated that any variety of different devices may be used for fall detection in the penalty zone 50 and presence detection in the safe zones 52A, 52B, and that the scanning laser rangefinder and camera devices with object detection software are merely non-limiting examples of suitable detection equipment, other examples of which includes appropriately positioned infrared sensors, other motion detectors, and break-beam sensors. Also, while the illustrated embodiment has the wall-traversal course installed on the outer perimeter wall structure of the room, other embodiments may have it situated on the inner wall structure 24, for example spanning the two mid-side walls and the rear inner wall spanning therebetween.

Figure 9:
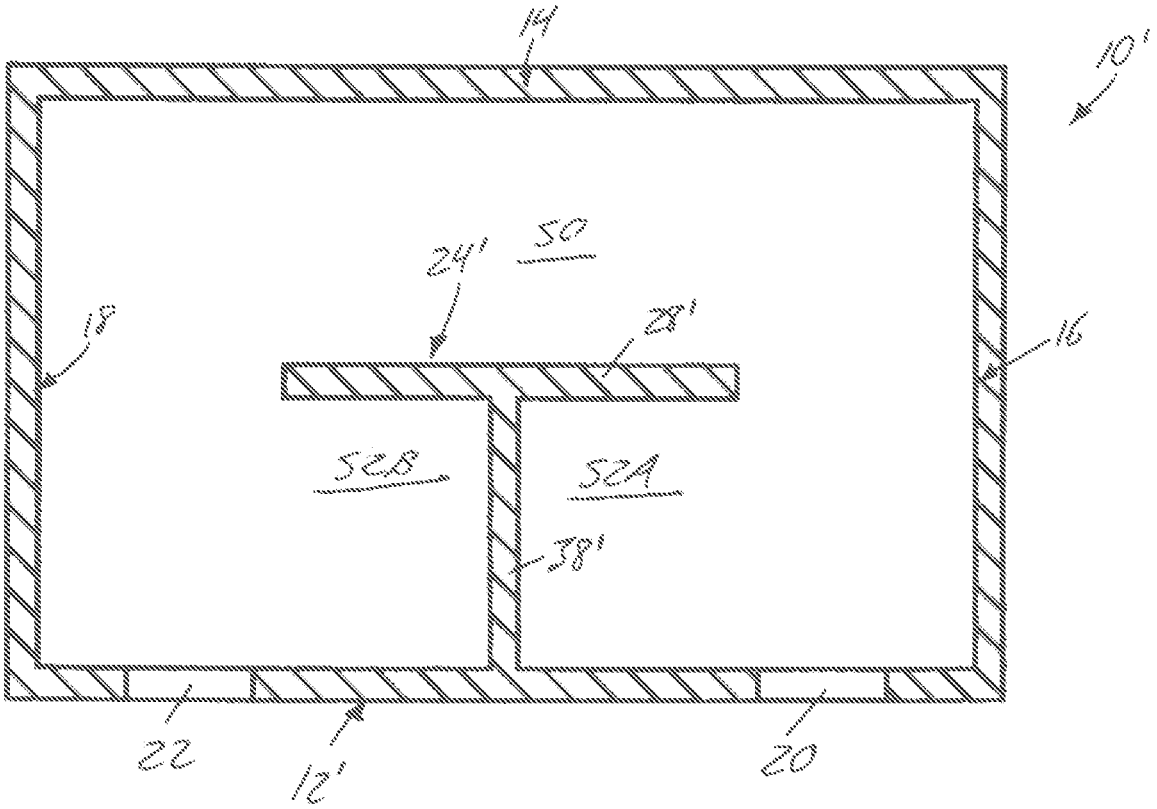
FIG. 9 illustrates an alternate room construction for the amusement attraction of FIG. 1 with a simplified inner wall structure achieving similar layout of the wall-traversal course.

FIG. 9 shows an alternate room construction 10' of similar externally rectangular shape to that of the earlier figures, and likewise suited for installation of the wall-traversal course on the rear perimeter wall 14 and two perimeter side walls 16, 18. The alternate construction differs primarily in that the inner wall structure 24' is a smaller simplified structure that doesn't define an internal void space 26, and that the front perimeter wall 12' is an undivided full-length wall spanning the entire room width, rather than being divided into separates halves by the void space. This simplified inner wall structure 24 features only two perpendicularly intersecting walls, namely a rear inner wall 28' of matching placement and orientation to that described above for the earlier figures, and a singular divider wall 38' that replaces the front-side walls 38, 40. This divider wall 38' spans perpendicularly between the rear inner wall 28' and the full-length front wall 12 at a midpoint thereof, and therefore lies in parallel relation to the two perimeter side walls 16, 18 at a central distance therebetween. This simplified inner wall structure has the same resultant effect of defining safe-zone alcove spaces 52A, 52B near the entrance 20 and exit 22. Each safe-zone alcove space 52A, 52B is defined between the front side of the rear inner wall 28' and the rear side of the front perimeter wall 12', and resides on a respective side of the divider wall 38' that serves to divide and isolate the two alcoves from one another.

In other embodiments, the course need not be delimited be a closed room structure with a dedicated entrance and exit to the course, and instead could employ a free-standing structure in a larger open room, or even outdoor environment, with the fall detection system operating on the adjacent penalty zone floor surface situated on the hold-equipped side of one or more hold-equipped walls.

As can be seen in FIGS. 1 to 3, in addition to the handholds 42 and goal devices 48A, 48B, the interior space of the room in the illustrated embodiment also includes at least one performance display operable to display performance feedback to the participant(s), for example to show one or more of: a score tally of incrementing/decrementing point values during successful completion or failure of tasks (e.g. incremented points for successful traversal of the course and activation of goal device 48A, 48B), a running timer, and/or a status meter whose level is incremented or decremented in response to detected failures (e.g. falling to the penalty zone floor surface during traversal of a wall), similar to a life-bar or health-meter of a video game. In the illustrated embodiment, instead of maintaining a separate score tally, a countdown timer is used to both limit the duration of a gameplay session, and at least partially govern a scoring scheme under which points are only awarded at the end of the gameplay session if all assigned tasks are completed before expiry of the countdown timer. If the countdown timer expires and any assigned task remains incomplete, the participant(s) is/are deemed to have lost the game, and no points are awarded. If all assigned tasks are completed before expiry of the countdown timer, then the participant(s) is/are deemed to have won the game, and is/are awarded a score value equal to the value of the countdown timer at the point in time when the final task was completed. If the life/health status of the status meter reaches zero before expiry of the countdown timer, the gameplay session is terminated prematurely, with the participant(s) being deemed to have lost the game, and therefore being awarded no points regardless of the value of the countdown timer at the premature termination of the gameplay session.

In the illustrated embodiment, the running value of the countdown timer is shown on a score display 60, for example a wall-mounted flat-screen monitor, and the status meter is shown in a separate status display 62, for example in the form of a plurality of discrete illuminable indicators each representing a respective life or health point that changes from one status to another (lit or unlit) in response to a detected gameplay failure. For example, a series of heart-shaped indicators may initially occupy a fully lit state representing a full-life or full-health status of maximum lives or health points, and then be turned off one-by-one in response to each gameplay failure detected in the game session, until none of the indicators are lit. Alternatively, rather than the discrete indicators being heart-shaped to denote health or livelihood when illuminated, they may be X-shaped or skull-shaped to denote health damage or loss of life, thus all starting in an unlit state and then being illuminated one-by-one in response to gameplay failures until all indicators are illuminated. Either way, once all the indicators have changed state, this denotes a loss of the game by its participants, i.e. a "game over" status. The status display 62 may optionally be incorporated into the score display 60. Instead of using the timer for one-time score determination at the end of a won game, an accruing score tally may be instead maintained independently of the timer during the gameplay session, in which case the running score tally may be shown on the score display 30, optionally together with the running countdown timer.

Figure 7:
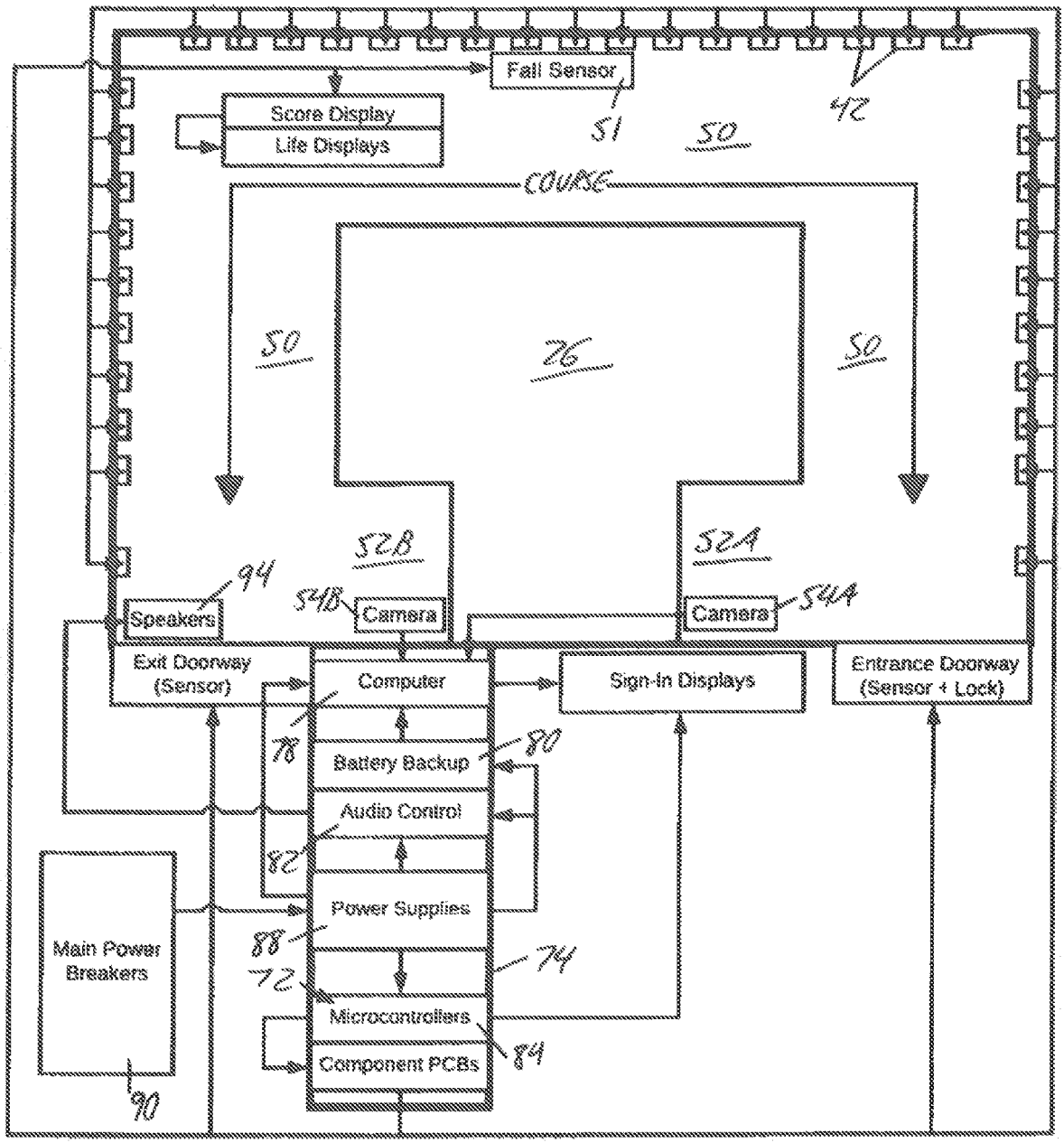
FIG. 7 is a schematic illustration of a control system for the attraction of FIGS. 1 through 6.

FIG. 7 schematically illustrates a control system of the amusement attraction 10. The control system features a collection of control hardware 72, optionally stored in a utility closet 74 situated outside the perimeter wall structure, as shown, or optionally in the central void space 26 or at some other location. In the illustrated embodiment, the control hardware 72 includes one or more local computers 78, a battery backup 80, audio control components 82 including at least an audio amplifier, microcontrollers 84, component PCBs 86, and power supplies 88 through which the other control hardware components are powered via main power breakers 90 situated further upstream in the facility's electrical system. Based on input commands from the local computer 78 during execution of game-control software installed thereon, the micro-controllers 84 drive the component PCBs of gameplay elements installed within the internal space of the room for interaction therewith by participants during gameplay. The audio control components 82 are connected to one or more loudspeakers 94 likewise installed in the internal space of the room 10 for playback of game-related audio to the participants during such gameplay, for example verbal commands guiding the participants as to assigned tasks they are to perform during the gameplay session. Accordingly, the control hardware 72 collectively forms a controller that governs automated execution of a gameplay session within the internal space of the room.

The control system may be one of a plurality of control systems that are installed among a plurality of respective game rooms in a shared facility, and are networked together over a local area network as part of a larger overall computerized facility management system. Such facility management system may include a facility management server that hosts, or is communicable with, a local participant database for storing participant profiles and associated scoring records of the participants. There may also be a central participant database that is hosted remotely of the facility, for example in a cloud server environment, and is communicable with the facility management server via the internet or another wide area network so that participant profiles from the local participant database can be used to populate the central participant database. The facility management servers of additional facilities can thus access and populate the central participant database, whereby a participant can attend multiple facilities and the scoring results from games played at multiple facilities can be compiled together. Further details on the facility management system, and functions of the control system other than the wall-traversal gameplay processes described herein, are disclosed in Applicant's prior U.S. Provisional Patent Application No. 62/846,912, filed May 13, 2019, the entirety of which is incorporated herein by reference.

In the illustrated embodiment of the present invention, the game elements operated by the controller 72 include the aforementioned sensors and illumination devices of the handholds 42; the aforementioned goal devices 48A, 48B; the aforementioned score/timer display 60 and status display 62; the aforementioned fall detection device(s) 51; and the aforementioned safe zone detection devices 54A, 54B. The controller 72 is configured to enable selective illumination of any handhold 42 in any one of three different colours via the RGB LED or other multi-colour illumination device of the handhold 42, and to monitor for physical gripping of any handhold by a participant via the touch sensor of the handhold 42. The game control software is composed of executable statements and instructions stored in non-transitory computer readable memory of the local computer(s) 78 for execution by one or more processors thereof. Embodied in this software code are a plurality of pre-programmed wall-traversal routing plans, each of which maps a different unique combination of "authorized" handholds that a participant is permitted to use without penalty during traversal of the course under that routing plan, "prohibited" handholds that a participant is forbidden from using during traversal of the course under that routing plan, and "targeted" handholds that the participant is specifically required to grasp during traversal of the course under that routing plan.

Each of these three software-specified categories of handhold (authorized, prohibited and targeted) is mapped in the software code to a different one of the three distinct illumination colours of the multi-colour illumination devices of the handholds 42. In one non-limiting example employing RGB LEDs, the RGB implementation designates "green" illumination for authorized handholds, "red" illumination for prohibited handholds, and "blue" illumination for targeted handholds. Accordingly, each unique routing plan stores therein a unique illumination pattern for the overall collection of handholds in the attraction, of which a first subset are authorized handholds illuminated in green, a second subset are prohibited handholds illuminated in red, and a third subset are targeted handholds illuminated in blue. Accordingly, the illumination pattern executed under each routing plan is unique from the illumination pattern executed under any other routing plan, whereby the different coloured patterns of the handholds will visually guide traversal of the course by participant's in a different manner via a unique combination of authorized, prohibited and targeted handholds illuminated in green, red and blue, respectively.

Figure 8:
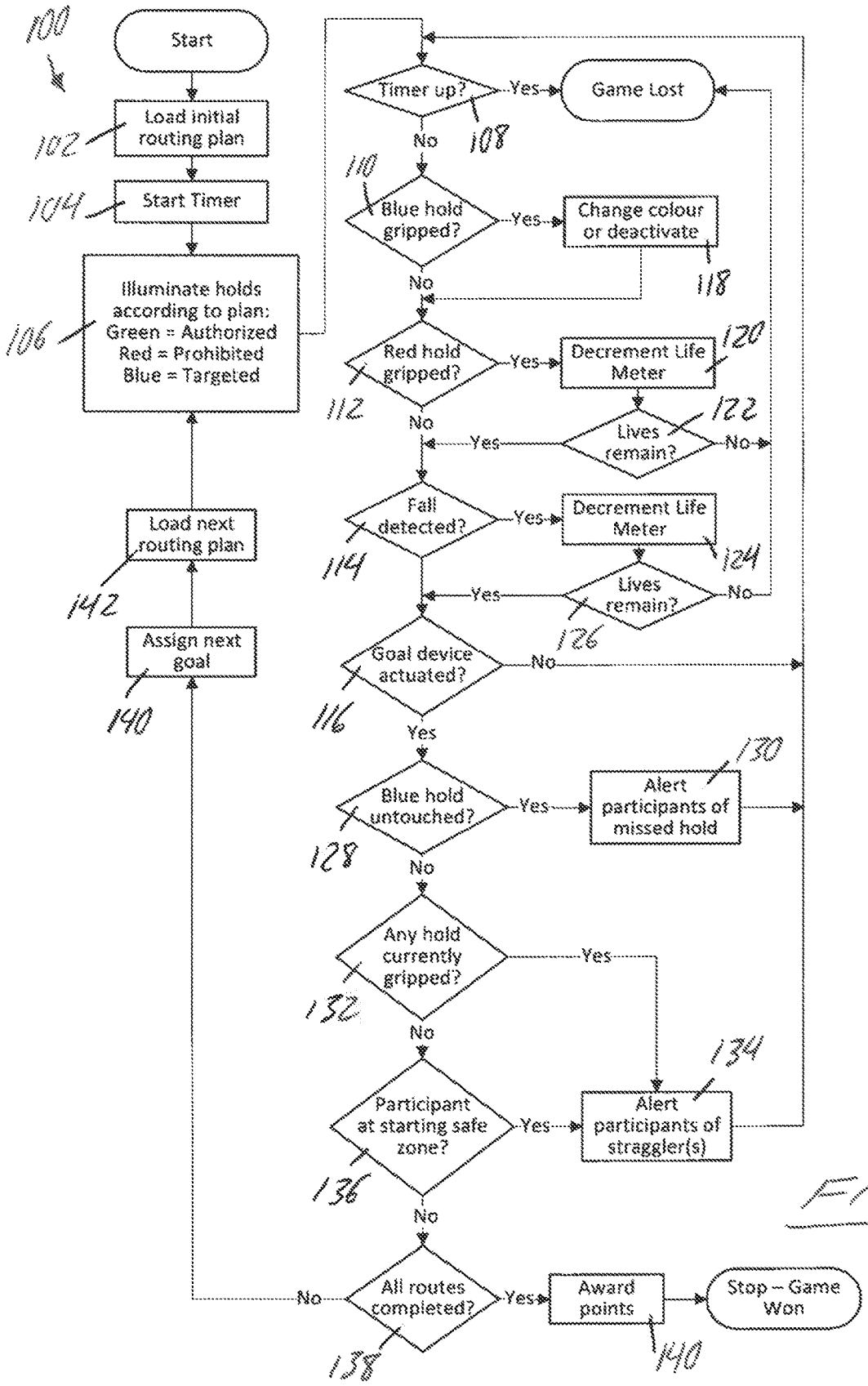
FIG. 8 is a flowchart illustrating a computer implemented process by which the control system of FIG. 7 executes an exemplary game play session within the immersive amusement attraction.

FIG. 8 shows one example of a computer-implemented process 100 performed by the controller to carry out a gameplay session in the illustrated game room 10, where the primary or exclusive gameplay task assigned to the participants is to successfully traverse the course from one end thereof in a predetermined direction and actuate the goal device 48A, 48B at the opposing end, without using any of the prohibited handholds illuminated in red, and specifically ensuring to grasp the targeted handholds illuminated in blue. Accordingly, only green and blue illuminated handholds can be used, of which the grasping of the targeted blue handholds is a mandatory part of the game task. The same type of task is then to be performed the reverse direction, but with the handholds illuminated in a different pattern according to a different routing plan. Accordingly, with each task iteration, the controller 72 loads another routing plan to vary the particular combination of authorized, prohibited and targeted handholds shown in illuminated color-code fashion to the participants, and optionally may load these routing plans in a manner of increasing complexity over time, whether increasing the course complexity with each individual iteration, or periodically after a certain number of iterations of relatively similar complexity.

At the first step 102 of the process 100, the controller 72 initiates the gameplay session by loading an initial routing plan from among a selected batch of the pre-programmed routing plans embodied in the software code. Via an electronic sign-in station of the room that is connected to the local computer(s) 48, the participants may be able select different game options for the given game session prior to initialization thereof, for example to select from among different difficulty levels of escalating value (level 1, level 2, level 3, etc.). To better ensure gameplay does not become predictable to repeat participants, the batch of routines for a game session may be selected randomly from among a larger pool of level-specific routines, optionally with further randomization of the order in which the batched routines are loaded and executed in the gameplay session. The sign-in station preferably resides near the entrance of the room, and preferably outside the room to enable sign-in by waiting participants while current participants are involved in a gameplay session inside, and may be used to govern the admission of participants, for example in the manner described in applicant's aforementioned U.S. provisional patent application incorporated herein.

In preferred embodiments where a gameplay session is a timed session having a predetermined time limit, then at step 104 the controller 72 starts running the timer to countdown the predetermined time limit, and shows the running countdown timer on the score display 60 of the room throughout the duration of the gaming session. Together or concurrently with starting of the timer, the controller 72 illuminates the authorized, prohibited and targeted handholds in their different colours at step 106 according to the selected routing plan. With the handholds illuminated, the controller 72 continually monitors for: expiration of the timer, participant grasping of any targeted blue handholds, participant grasping of any prohibited red handholds, triggering of the fall detector 51, and actuation of the subject goal device 48A, 48B for the current iteration, as shown respectively at steps 108, 110, 112, 114, 116. Illumination of the handholds 42 at step 106 may be accompanied by illumination of the assigned goal device so that it's visually recognizable to the participants as their targeted end goal on arrival at the other end of the course. Illumination of the handholds at step 106 may also be accompanied by automated playback of verbal instructions over the loudspeaker 94 to inform the participants that their task is to reach and actuate the assigned/illuminated goal device without touching the penalty zone floor surface 50, and without touching the prohibited red handholds, while ensuring to grasp all targeted blue handholds (if any are illuminated under the current routing plane) along the way. Routing plans of lower complexity for one or more lower difficulty levels may optionally omit inclusion of any blue targeted handholds, thereby simplifying the task to traversal of the course using only authorized green handholds.

If expiration of the timer is detected at step 108, then this denotes loss of the game by the participant(s), and the controller 72 terminates the game session. Otherwise, the game session continues. If grasping of a targeted blue handhold is detected at step 110, then at step 118, the controller 72 may change the mapped status of this handhold from "targeted" to either "authorized" or "prohibited", and change the illuminated colour thereof to green or red accordingly. Alternatively, the controller 72 may change the mapped status of this handhold to "inactive" and deactivate its illumination device altogether. Which of these actions is taken in a particular iteration of the process may be governed by the selected difficulty level of the current gameplay session, or the currently selected routing plan of the game session in embodiments where the difficulty is somewhat incremented from plan to plan within a given level. For example, in less challenging routing plans for a lower difficulty level, the status of the gripped handhold from step 110 may be changed from "targeted" to "authorized", and the illumination colour accordingly changed from blue to green at step 118. In a more challenging routing plan for intermediate or higher difficulty levels, the status of the gripped handhold from step 110 may be changed to "inactive", and its illumination device accordingly deactivated at step 118, making the handhold notably less visible to the participants in the preferably darkened environment of the room. In another challenging routing plan for intermediate or higher difficulty levels, the status of the gripped handhold from step 110 may be changed to "prohibited", and its illumination device accordingly changed from blue to red at step 118.

If grasping of a prohibited red handhold is detected at step 112, then at step 120, the controller 72 decrements the current value of the status meter 62 by one life or health point. In response to this detected grasping of a prohibited red handhold, the controller checks at step 122 whether the value of the status meter is now zero, denoting loss of all lives or health points, in which case the controller 72 terminates the game session, denoting loss of the game by the participant(s). Otherwise, the game session continues. Similarly, if a fallen participant is detected at step 114, then the controller 72 decrements the current value of the status meter 62 by one life or health point at step 124, and checks at step 126 whether the value of the status meter is now zero, in which case the game session is terminated, again denoting loss of the game. Otherwise, the game session continues.

So long as actuation of the currently assigned goal device 48A, 48B is not detected at step 116, the ongoing monitoring for timer expiration, targeted blue hold grasps, prohibited red hold grasps and falling participants continues through repetition of steps 108 to 116. Once actuation of the assigned goal device 48A, 48B is detected at step 116, this signifies a participant's potentially successful traversal of the course to the assigned goal device from the opposing end of the course from which the participant started. However, in the illustrated example where traversal of the course was only one part of the task, which also included mandatory grasping of all targeted blue handholds, an additional check is performed at step 128 as to whether there are any handholds still having a "targeted" status. If yes, then at step 130, the participant is alerted of this incomplete part of the task, for example by automated playback of verbal instruction over the loudspeaker 94 informing them of the failure to grasp all targeted handholds. In the event of a single-participant game session, the participant can travel back through the course to seek out and grasp the missed targeted handhold(s), or the in the event of a multi-participant game session, another participant still working their way through the course can keep an eye out for the missed targeted handhold(s). After such informing of the participant(s) at step 130, steps 108 through 116 are repeated.

If it is determined at step 128 that no targeted blue handholds were missed, then at step 132, the controller 72 checks whether the sensors of any handholds are currently detecting grasping thereof by a participant, i.e. thereby confirming whether there are any remaining participants still traversing the course. If so, then the participants are informed, for example by automated playback of verbal notification at step 134, that the current task is incomplete because one or more straggling participants have yet to successfully traverse the course. Steps 108 through 116 are repeated. On the other hand, if at step 132 no grasping of any of the handholds is detected, then at step 136, a check is made for the presence of any participants still residing in the safe zone 52A, 52B from which the participants started the current task, thereby checking for potential cheaters as described above. Here, the gameplay control software running on the local computer 78 connected to the safe zone detection devices 54A, 54B triggers image capture by these devices, and initiates image analysis thereon by integrated or separate object-detection software to detect whether any participant is present in the safe zone 52A, 52B concerned. If participant presence is detected, then the participants are informed at step 134 of the tasks incompletion to due the detection of such straggling participant(s) yet to complete the course. On the other hand, if no straggling participants are found at either of steps 132 or 136, then the controller 72 has confirmed successful completion of the current participant task.

In the illustrated embodiment, where scoring is purely timer based, this successful task completion does not trigger any accrual of scoring points to a running score tally. However, in other implementations employing such a tally, successful completion of the task may be correlated to awardal of a predetermined quantity of scoring points, the value of which being dictated by the game control software, in which case, upon positive task completion at step 136, such scoring points would be accrued to the running score tally maintained by the software during the gameplay session, and optionally updated in real-time on the score display 60.

In the illustrated embodiment, instead of accruing points, the controller checks at step 138 whether the entire batch of routing plans for the current game session have been completed. If there is at least one unexecuted routing plan remaining among the current batch, then the controller 72 prepares for the next participant task, by assigning the other goal device as the goal for that next task, and loading the next routing plan of the current batch to govern the executed illumination pattern during that next task, as shown at steps 140 and 142. The process then returns back to step 106 to initiate the next task iteration with the newly loaded routing plan, and repeats the subsequent steps 108 to 138 over again, either until the gameplay session is terminated by expiration of the timer at step 108 or reduction of the status meter level to zero at step 122 or 126, or until step 138 reveals that all of the batched routing plans of the current session have been completed, thereby denoting that the participant(s) has/have won the game. In the event of such a win, then final step 140 sees the controller award points to the scoring record(s) of the participant(s), at least partly based on the remaining value of the countdown timer.

In embodiments, with different user-selectable difficulty levels, instead of solely awarding a timer-based score, the awarded points at step 140 may be the sum of the remaining value of the countdown timer, plus a level-dependent bonus value that is proportional to the user-selected difficulty level. The bonus value may be the multiplication product of a fixed bonus factor and a numerical level identifier. In one example, where each difficulty level is identified by a respective integer value (Level 1, Level 2, Level 3), and the fixed bonus factor is 1000, the bonus value is therefore 1000 for Level 1, 2000 for Level 2, 3000 for Level 3, etc. By supplementing the timer-based score component with a bonus value proportional to the difficulty level, participants are more likely, or guaranteed, to achieve a greater overall score for completion of a harder level than an easier level, even if the harder level took longer to complete. So using this example, if the countdown timer counts in seconds, with each remaining second being worth one point at the end of the session, a participant who wins a Level 2 gameplay session with only 10-seconds left will earn 2010 points, while a participant who wins a Level 1 gameplay session with 60-seconds left will only earn 1060 points.

It will be appreciated that the countdown timer need not necessarily be measured in seconds. Also, the ratio between the timer value and timer-awarded point value may be varied from the forgoing 1:1 example, for example to adjust the relative weight ascribed to the difficulty level vs. the speed of completion. Ascribing a greater point value per second would afford greater weight to the speed of completion, whereby a participant completing a gameplay session at an excessively fast speed at a lower difficulty level would be able to achieve a more closely comparable score to another participant's slower completion of a harder difficulty level.

While the illustrated embodiment contemplates three software-controlled categories of handholds (authorized, prohibited and targeted), it will be appreciated an alternative implementation may optionally omit the inclusion of the "targeted" handhold category and associated steps of the described methodology, without sacrificing the novelty and inventiveness of a system and method employing the computer-controlled and visually recognizable colour coding of authorized and prohibited holds in a variety of different routing plans, together with automated computer-implemented monitoring of participant grasping of prohibited holds to penalize participants in a wall-traversal gameplay session. It will also be appreciated that though the illustrated example applies the penalization for fallen participants and prohibited handholds in terms of lost lives or health points on a status meter that is decremented according to such detected task failures, it will be appreciated that a points-based penalization may alternative be applied for detected task failures, whether detected falling of a participant and/or detected grasping of prohibited handholds.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. An amusement system comprising:

a wall structure comprising one or more upright walls;

a set of handholds on the one or more upright walls in positions distributed over a wall area of said one or more upright walls for use as hand grips by which one or more participants can support themselves on said one or more upright walls, and thereon traverse a course that spans from a starting point adjacent a first end of the wall area to an end point adjacent a second end of the wall area, of which said second end is of horizontally distant relation to said first end;

a floor surface comprising a penalty zone residing adjacent to said one or more upright walls on a side thereof faced by the wall area;

one or more penalty detection devices positioned and configured relative to said one or more upright walls and said floor surface to monitor the penalty zone for detected landing of any participant thereon during attempted traversal of the course via said set of handholds;

a participant-actuable goal device residing proximate the end point of the course and operable to receive user-input from any of said one or more participants upon successful traversal of the course from the start point thereof to the end point thereof; and a controller configured to execute a gameplay session, and therein monitor for both said user-input at the participant-actuable goal device and said detected landing on the penalty zone; and for each handhold, a multi-colour illumination device illuminable in at least first, second and third non-matching colours, and a sensor operable to detect grasping of the handhold by any one of the one or more participants;

wherein the controller is configured to execute gameplay routines that illuminate the illumination devices in a variety of different colour-coded patterns, of which at least one of said routines includes illumination of the illumination devices of a first subset of the handholds in the first colour to visually identify said first subset of handholds as authorized handholds to be used by the one or more participants during traversal of the course, illumination of the illumination devices of a second subset of the handholds in the second colour to visually identify said second subset of handholds as prohibited handholds to be avoided by the participant during traversal of the course, illumination of the illumination devices of a third subset of the handholds in the third colour to visually identify said third subset of handholds as targeted handholds to be specifically grasped by participants during traversal of the course, and, after detected actuation of the goal device, check for positively detected grasping of all handholds among the third subset.

2. The system of claim 1 wherein the further comprises one or more safe zones that reside outside the penalty zone and are unmonitored by the one or more penalty detection devices.

3. The system of claim 2 wherein said one or more safe zones comprises a starting safe zone residing adjacent to the first end of the wall area and the starting point of the course.

4. The system of claim 3 further comprising a safe-zone detection device operable to detect presence of any participant at the starting safe zone.

5. The system of claim 4 wherein the controller is configured to, in at least some instances after actuation of the goal device, check the safe-zone detection device for said presence of any participant at the starting safe zone.

6. The system of claim 2 wherein said one or more safe zones comprises a finishing safe zone residing adjacent to the second end of the wall area and the end point of the course.

7. The system of claim 1 wherein the wall structure further comprises a foot-ledge protruding from the wall area at a spaced elevation below the respective set of handholds and above said floor surface, said foot ledge has an upper surface atop which the one or more participants must stand, and an entirety of said upper surface resides in spaced elevation above the penalty zone of the floor surface.

8. The system of claim 7 wherein said upper surface of the foot-ledge slopes downwardly away from the wall area.

9. The system of claim 1 wherein the controller is configured to, in response to detected grasping of a grasped handhold of among the third subset, change an illumination state of the illumination device of said grasped handhold, while continuing to maintain an existing illumination state of the illumination devices of as-yet ungrasped handholds among the third subset, as well as the illumination devices of the handholds of the first and second subsets.

10. The system of claim 1 comprising a second participant-actuable goal device residing proximate the starting point of the course to receive another user-input from any of said one or more participants upon successful traversal of the course in a reverse direction from the end point of the course to the start point thereof, and the controller is configured to, in at least one instance, monitor for said another user-input at the second participant-actuable goal device.

11. An amusement system comprising:

a wall structure comprising one or more upright walls;

a set of handholds on the one or more upright walls in positions distributed over a wall area of the one or more upright walls for use as hand grips by which one or more participants can support themselves on said one or more upright walls, and traverse a course thereon;

a respective multi-colour illumination device for each handhold that is illuminable in at least first, second and third non-matching colours;

a controller configured to execute gameplay routines that illuminate the illumination devices in a variety of different colour-coded patterns, among which at least one of said gameplay routines includes illumination of the illumination devices of a first subset of the handholds in the first colour to visually identify said first subset of handholds as authorized handholds to be used by the one or more participants during traversal of the course, illumination of the illumination devices of a second subset of the handholds in the second colour to visually identify said second subset of handholds as prohibited handholds to be avoided by the one or more participants during traversal of the course, illumination of the illumination devices of a third subset of the handholds in said third colour to visually identify said third subset of handholds as targeted handholds to be specifically grasped by the one or more participants during traversal of the course; and for each handhold, a respective sensor operable to detect gasping thereof by any one of the one or more participants, wherein the controller is configured to, in said at least one of the gameplay routines, and in response to detected grasping of a grasped handhold among the third subset, change an illumination state of the illumination device of said grasped handhold of the third subset, while continuing to maintain an existing illumination state of the illumination device of any as-yet ungrasped handholds among the third subset, as well as the illumination devices of the handholds of the first and second subsets.

12. The system of claim 11 wherein the controller is configured to change said illumination state of said grasped handhold of the third subset, in at least one instance, by changing the illuminated colour of the respective illumination device of said grasped handhold of the third subset.

13. The system of claim 11 wherein the controller is configured to change said illumination state of the respective illumination device of said grasped handhold of the third subset by, in at least one instance, deactivating the respective illumination device of said grasped handhold of the third subset.

14. An amusement system comprising:

a wall structure comprising one or more upright walls each comprising a respective wall surface;

a respective set of handholds on at least one upright wall of the structure in positions distributed over a surface area of the respective wall surface for use as hand grips by which one or more participants can support themselves on, and traverse across, said respective wall surface;

a respective multi-colour illumination device for each handhold that is illuminable in at least first, second and third non-matching colours;

a controller configured to execute different gameplay routines that illuminate the illumination devices in a variety of different colour-coded patterns, at least one of said routines includes illumination of the illumination devices of a first subset of the handholds in the first colour to visually identify said first subset of handholds as authorized handholds to be used by the one or more participants during traversal of the wall surface, illumination of the illumination devices of a second subset of the handholds in the second colour to visually identify said second subset of handholds as prohibited handholds to be avoided by the one or more participants during traversal of the wall surface, illumination of the illumination devices of a third subset of the handholds in said third colour to visually identify said third subset of handholds as targeted handholds to be specifically grasped by the one or more participants during traversal of the wall surface; and for each handhold, a respective sensor operable to detect grasping thereof by any one of the one or more participants;

wherein the controller is configured to, in said at least one of the routines, monitor for grasping of handholds of at least the third subset at least the third subset, and switch the illumination devices to another of the different colour-coded patterns after having positively detected grasping of all said handholds among the third subset.

* * * * *